US010508587B2

(12) United States Patent
Gesa et al.

(10) Patent No.: US 10,508,587 B2
(45) Date of Patent: Dec. 17, 2019

(54) CONTROLLING COOLANT FLUID IN A VEHICLE COOLING SYSTEM USING A SECONDARY COOLANT PUMP

(71) Applicant: GM Global Technology Operations LLC, Detroit, MI (US)

(72) Inventors: Vincenzo Gesa, San Nicola Baronia (IT); Luca Scavone, Moncalieri (IT); Andrea Lorena Miss Torres Cuadros, Turin (IT); Giuseppe D'Aurizio, Lanciano (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 172 days.

(21) Appl. No.: 15/662,817

(22) Filed: Jul. 28, 2017

(65) Prior Publication Data

US 2019/0032537 A1 Jan. 31, 2019

(51) Int. Cl.
*F01P 7/14* (2006.01)
*F01P 5/12* (2006.01)
(Continued)

(52) U.S. Cl.
CPC *F01P 7/14* (2013.01); *F01P 3/02* (2013.01); *F01P 5/12* (2013.01); *F01P 7/165* (2013.01); *F01P 2003/027* (2013.01); *F01P 2005/105* (2013.01); *F01P 2005/125* (2013.01); *F01P 2025/08* (2013.01); *F01P 2025/62* (2013.01); *F01P 2031/30* (2013.01); *F01P 2060/04* (2013.01); *F01P 2060/045* (2013.01)

(58) Field of Classification Search
CPC ..... F01P 7/14; F01P 5/12; F01P 2005/125; F01P 2025/08; F01P 2025/62; F01P 2031/30; F02D 2200/021; F02D 2200/1002; F02D 2200/101
See application file for complete search history.

(56) References Cited

U.S. PATENT DOCUMENTS 4,728,306 A * 3/1988 Schneider ..... F01P 3/207 123/41.02
6,082,626 A * 7/2000 Morikawa ..... B60H 1/02 237/12.3 B (Continued)

*Primary Examiner* — Erick R Solis
*Assistant Examiner* — Anthony L Bacon
(74) *Attorney, Agent, or Firm* — Cantor Colburn LLP

(57) ABSTRACT

Examples of techniques for controlling coolant flow in a vehicle cooling system for an internal combustion engine using a secondary coolant pump are provided. In one example implementation, a computer-implemented method includes receiving, by a processing device, engine operation data about the internal combustion engine. The method further includes detecting, by the processing device, a shutdown of the internal combustion engine. The method further includes calculating, by the processing device, an engine flow based at least in part on the block flow request and the head flow request. The method further includes, subsequent to detecting the shutdown of the internal combustion engine determining, by the processing device, an after-run condition based at least in part on the engine operation data. The method further includes activating, by the processing device, a secondary coolant pump based at least in part on determining the after-run condition.

14 Claims, 4 Drawing Sheets

(51) Int. Cl.

| | |
|---|---|
| ***F01P 3/02*** | (2006.01) |
| ***F01P 7/16*** | (2006.01) |
| *F01P 5/10* | (2006.01) |

(56) References Cited

U.S. PATENT DOCUMENTS

| | | | | |
|---|---|---|---|---|
| 2004/0103862 | A1* | 6/2004 | Aidnik | F01P 7/164 123/41.29 |
| 2005/0028756 | A1* | 2/2005 | Santanam | F01P 7/165 123/41.1 |
| 2006/0089767 | A1* | 4/2006 | Sowa | G01M 15/05 701/31.4 |
| 2011/0214627 | A1* | 9/2011 | Nishikawa | F01P 7/04 123/41.02 |
| 2013/0333863 | A1* | 12/2013 | Pawellek | F01P 5/12 165/104.19 |
| 2014/0260199 | A1* | 9/2014 | Grzesiak | F01N 3/0871 60/274 |
| 2014/0283764 | A1* | 9/2014 | Abou-Nasr | F01P 7/162 123/41.02 |
| 2015/0129161 | A1* | 5/2015 | Nishikawa | B60K 11/02 165/43 |
| 2015/0275741 | A1* | 10/2015 | Amano | B60W 20/00 60/320 |
| 2017/0107891 | A1* | 4/2017 | Murai | F01P 3/02 |

* cited by examiner

CONTROLLING COOLANT FLUID IN A VEHICLE COOLING SYSTEM USING A SECONDARY COOLANT PUMP

INTRODUCTION

The present disclosure relates generally to internal combustion engines and more particularly to controlling coolant flow in a vehicle cooling system for an internal combustion engine using a secondary coolant pump.

A vehicle, such a car, motorcycle, or any other type of automobile may be equipped with an internal combustion engine to provide a source of power for the vehicle. Power from the engine can include mechanical power (to enable the vehicle to move) and electrical power (to enable electronic systems, pumps, etc. within the vehicle to operate). As an internal combustion engine operates, the engine and its associated components generate heat, which can damage the engine and its associated components if left unmanaged.

To reduce heat in the engine, a cooling system circulates a coolant fluid through cooling passages within the engine. The coolant fluid absorbs heat from the engine and is then cooled via a heat exchanger in a radiator when the coolant fluid is pumped out of the engine and into the radiator. Accordingly, the coolant fluid becomes cooler and is then circulated back through the engine to cool the engine and its associated components.

SUMMARY

Examples of techniques for controlling coolant flow in a vehicle cooling system for an internal combustion engine using a secondary coolant pump are provided. In one example embodiment, a computer-implemented method includes receiving, by a processing device, engine operation data about the internal combustion engine. The method further includes detecting, by the processing device, a shutdown of the internal combustion engine. The method further includes calculating, by the processing device, an engine flow based at least in part on the block flow request and the head flow request. The method further includes, subsequent to detecting the shutdown of the internal combustion engine determining, by the processing device, an after-run condition based at least in part on the engine operation data. The method further includes activating, by the processing device, a secondary coolant pump based at least in part on determining the after-run condition.

In another example embodiment, a system for controlling coolant fluid in cooling system for an internal combustion engine using a secondary coolant pump includes a memory comprising computer readable instructions and a processing device for executing the computer readable instructions for performing a method. The method includes receiving, by a processing device, engine operation data about the internal combustion engine. The method further includes detecting, by the processing device, a shutdown of the internal combustion engine. The method further includes calculating, by the processing device, an engine flow based at least in part on the block flow request and the head flow request. The method further includes, subsequent to detecting the shutdown of the internal combustion engine determining, by the processing device, an after-run condition based at least in part on the engine operation data. The method further includes activating, by the processing device, a secondary coolant pump based at least in part on determining the after-run condition.

In another example embodiment, a computer program product for controlling coolant fluid in cooling system for an internal combustion engine using a secondary coolant pump includes a computer readable storage medium having program instructions embodied therewith, wherein the computer readable storage medium is not a transitory signal per se, the program instructions executable by a processing device to cause the processing device to perform a method. The method includes receiving, by a processing device, engine operation data about the internal combustion engine. The method further includes detecting, by the processing device, a shutdown of the internal combustion engine. The method further includes calculating, by the processing device, an engine flow based at least in part on the block flow request and the head flow request. The method further includes, subsequent to detecting the shutdown of the internal combustion engine determining, by the processing device, an after-run condition based at least in part on the engine operation data. The method further includes activating, by the processing device, a secondary coolant pump based at least in part on determining the after-run condition.

According to one or more embodiments, the engine operation data is received periodically and stored in a circular buffer. According to one or more embodiments, the engine operation data comprises speed data and torque data. According to one or more embodiments, the method further includes calculating an average power based at least in part on the speed data and the torque data, and calculating an average torque based at least in part on the torque data. According to one or more embodiments, the method further includes comparing the average power to a power threshold and comparing the average torque to a torque threshold. According to one or more embodiments, determining the after-run condition is based at least in part on at least one of the average power exceeding the power threshold or the average torque exceeding the torque threshold. According to one or more embodiments, the internal combustion engine comprises a primary coolant pump and the secondary coolant pump. According to one or more embodiments, the after-run condition is selected from the group consisting of a high temperature, a high average power, and a high average torque.

The above features and advantages, and other features and advantages of the disclosure, are readily apparent from the following detailed description when taken in connection with the accompanying drawings.

BRIEF DESCRIPTION OF THE DRAWINGS

Other features, advantages, and details appear, by way of example only, in the following detailed description, the detailed description referring to the drawings in which.

DETAILED DESCRIPTION

Figure 1:
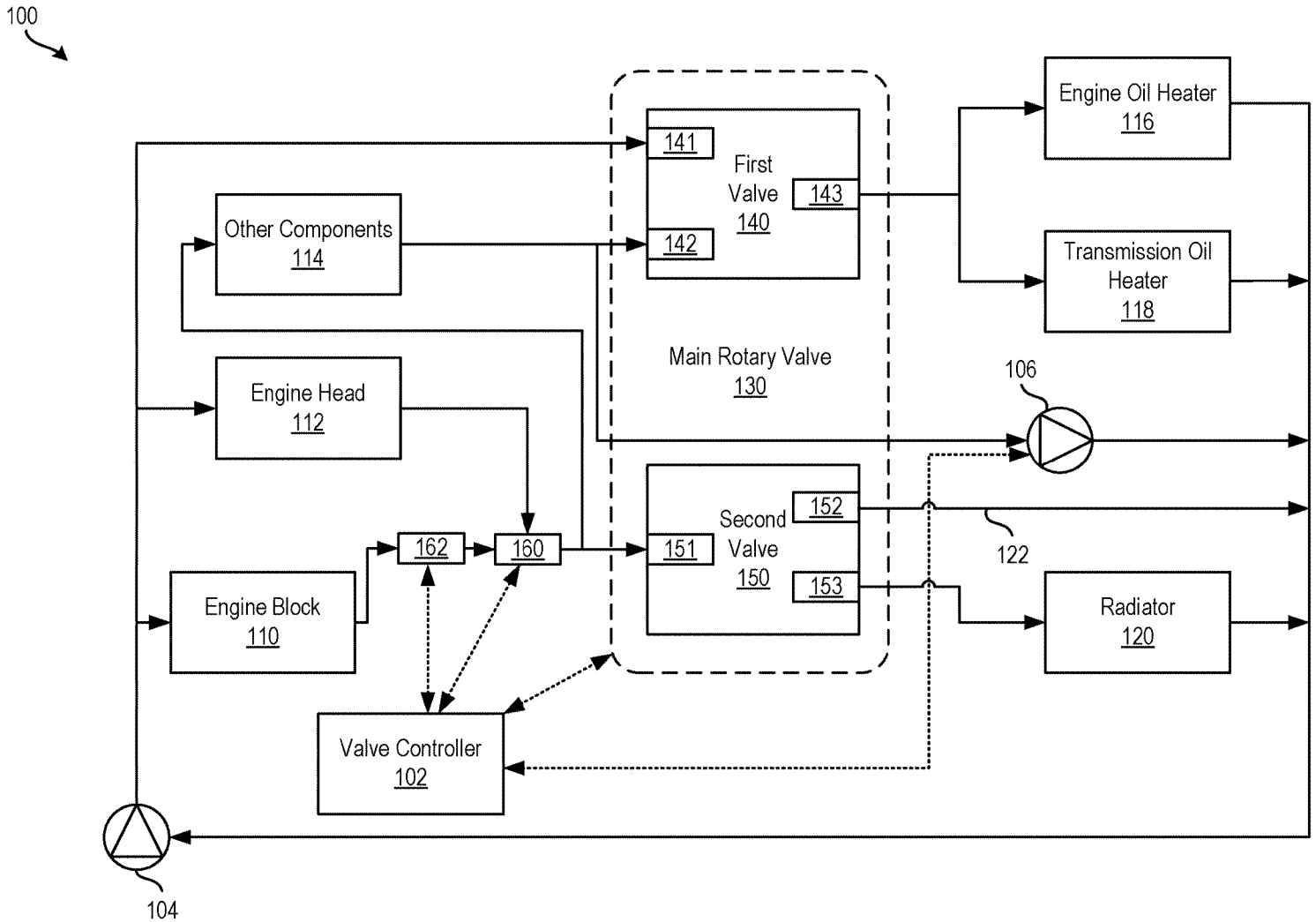
FIG. 1 depicts a thermal layout for a vehicle engine, the vehicle engine including a secondary coolant pump that can that control coolant fluid flow in the vehicle engine upon detection of an after-run condition, according to embodiments of the present disclosure.

The following description is merely exemplary in nature and is not intended to limit the present disclosure, its application or uses. It should be understood that throughout the drawings, corresponding reference numerals indicate like or corresponding parts and features. As used herein, the term module refers to processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

The technical solutions described herein provide for controlling coolant flow in a vehicle cooling system for an internal combustion engine ("engine") upon detection of an after-run condition of the engine using a secondary coolant pump. Some engines, such as a cylinder set strategy diesel engine, can include an auxiliary coolant pump to prevent the engines from overheating. An after-run condition is the period of time after the engine is shutdown. During this period, it may be desirable to continue to cool the engine using the vehicle coolant system (or portions thereof) to prevent overheating of engine hardware and to prevent overpressure of coolant fluid that can cause coolant fluid leakage due to boiling. The after-run condition is needed due to the slow transfer of energy (heat) from combustion chambers within the engine to different components of the engine. This may be particularly true after the engine has operated at high power, high torque, etc., conditions for prolonged periods.

The present techniques identify an after-run condition (e.g., prolonged operation of the engine at high power, etc.) based on sampling the torque and engine speed during driving cycles prior to engine shutdown and on consequently average torque and power demands at engine shutdown. For example, data about engine speed, torque, and power can be acquired over different periods of time and sampled at various frequencies. When an engine shutdown is detected, the average values determine whether an auxiliary coolant pump is activated to prevent an overheating condition.

Accordingly, thermal stress on the engine is reduced, preventing possible damage to, or failure of, the engine and its components. By controlling the temperature of the coolant fluid, it is possible to operate the engine at the highest temperature possible without comprising the hardware integrity of the engine. This increases engine and fuel efficiency while preventing failure of the engine.

FIG. 1 depicts a thermal layout for a vehicle engine 100, the vehicle engine 100 including a secondary coolant pump 106 that can that controls coolant fluid flow in the vehicle engine 100 upon detection of an after-run condition, according to embodiments of the present disclosure. The vehicle engine 100 includes at least a valve controller 102, a primary coolant pump ("primary pump") 104, a secondary coolant pump ("secondary pump") 106, an engine block 110, an engine head 112, other engine components 114 (e.g., a turbocharger, an exhaust gas re-circulator, etc.), a main rotary value 130, an engine oil heater 116, a transmission oil heater 118, a radiator 120, a flow control valve (FCV) 160, and a block rotary valve (BRV) 162.

The main rotary valve 130 includes a first valve (or chamber) 140 having a first inlet 141, a second inlet 142, and an outlet 143. The main rotary valve 130 also includes a second valve (or chamber) 150 having an inlet 151, a first outlet 152, and a second outlet 153. The various components of the vehicle engine 100 are connected and arranged as shown in FIG. 1 according to embodiments of the present disclosure, and the solid lines among the components represent the fluid connections among the components, with arrows representing the flow direction of the fluid.

According to examples of the present disclosure, the primary pump 104 is a mechanical pump driven by the engine, such as through a fan belt, a serpentine belt, or a timing belt. The secondary pump 106 is an electric pump that includes an electric motor driven by a power source such as a battery (not shown) within the vehicle.

When the engine is running (on), coolant fluid is cooled by the radiator 120 and is pumped out of the radiator 120 by the primary pump 104 and into the engine block 110, the engine head 112, and the other components 114 (collectively, the "inlet" of the engine). When the engine is not running (off), the primary pump 104 does not pump coolant fluid through the cooling system. However, because the secondary pump 106 is an electric pump, it can pump coolant fluid through the cooling system even when the engine is not running. The valve controller 102 can control the secondary pump 106 to cause the secondary pump 106 to change flow rates of the coolant fluid. The valve controller 102 can also enable and disable at least the secondary pump 106.

Coolant fluid cooled by the radiator 120 can also be pumped directly into the first inlet 141 of the main rotary valve 130. Managing the flow out of the radiator 120 enables mixing cold coolant with hot coolant in order to provide the coolant to the vehicle engine 100 at a desired temperature.

The valve controller 102 controls the flow of coolant fluid through the vehicle engine 100 by opening and closing the first valve 140 and the second valve 150. In particular, the inlet temperature controller 102 can cause the second valve 150 to direct flow from the engine block 110 and the engine head 112 into the radiator 120 and/or the radiator bypass 122 through the first outlet 152 and the second outlet 153. Similarly, the valve controller 102 can cause the first valve 140 to direct flow from either the first inlet 141 and/or the second inlet 142 into the engine oil heater 116 and the transmission oil heater 118 through the outlet 143.

The first inlet 141 (also referred to as the "cold inlet") receives cooled coolant fluid via the primary pump 104 from the radiator 120. The second inlet 142 (also referred to as the "warm inlet") receives warm coolant fluid (warm relative to the cooled coolant fluid) after it is pumped by the primary pump 104 through the engine block 110/engine head 112 and the other components 114. The warm coolant fluid is warmed as it passes through the engine block 110, the engine head 112, and/or the other components. Accordingly, depending on the state of the first valve 140, the first valve 140 can provide either cooled coolant fluid or warm coolant fluid to the engine oil heater 116 and the engine transmission oil heater 118.

To reduce an influx of cool coolant fluid in the engine block 110 and the engine head 112, a flow control valve (FCV) 160 can be closed between the engine block 110/engine head 112 and the second valve 150 of the main rotary valve 130. In particular, an inlet of the FCV 160 is in fluid communication (directly and/or indirectly) with an outlet of the engine block 110 and an outlet of the engine head 112. An outlet of the FCV 160 is in fluid communication with the inlet 151 of the second valve 150 of the main rotary valve 130 and an inlet of the other components 114.

When the FCV 160 is closed, the flow of coolant fluid into the radiator 120 is stopped so the coolant fluid is not cooled by the radiator 120. This prevents cooled coolant fluid from cycling back into the engine block 110/engine head 112. The valve controller 102 controls the FCV 160 to open and shut the FCV 160 based at least in part on state changes of the main rotary valve 130. According to some embodiments, the FCV 160 is partially closed (e.g., closed 25%, closed 50%, closed 80%, etc.) to achieve a desired flow (e.g., to maintain a consistent temperature through the vehicle engine 100).

However, in some situations, the engine block 110 and the engine head 112 may need different coolant fluid flow rates. For example, the engine block 110 and the engine head 112 each require a minimum flow to avoid boiling the coolant fluid and to prevent high temperatures within each component, which may cause damage thereto. Accordingly, the BRV 162 is introduced between an outlet of the engine block 110 and an inlet of the FCV 160 so that the BRV 162 is in fluid communication with the engine block 110 and the FCV 160. The BRV 162 is controllable by the valve controller 102 to provide the ability to flow coolant fluid through each of the engine block 110 and the engine head 112 at different rates.

The valve controller 102 can continuously regulate the FCV 160 and the BRV 162 to adjust the flow of coolant fluid that the primary pump 104 and/or the secondary pump 106 can provide through the engine block 110 and the engine head 112. By reducing the flow of the primary pump 104 and/or the secondary pump 106, it is possible to reduce also the load on the crankshaft (not shown), to reduce engine friction, and to maximize combustion efficiency.

With continuing reference to FIG. 1, in embodiments of the present disclosure, the valve controller 102 can be a combination of hardware and programming. The programming may be processor executable instructions stored on a tangible memory, and the hardware can include a processing device for executing those instructions. Thus a system memory can store program instructions that when executed by the processing device implement the functionality described herein. Other engines/modules/controllers may also be utilized to include other features and functionality described in other examples herein. Alternatively or additionally, the valve controller 102 can be implemented as dedicated hardware, such as one or more integrated circuits, Application Specific Integrated Circuits (ASICs), Application Specific Special Processors (ASSPs), Field Programmable Gate Arrays (FPGAs), or any combination of the foregoing examples of dedicated hardware, for performing the techniques described herein.

Figure 2:
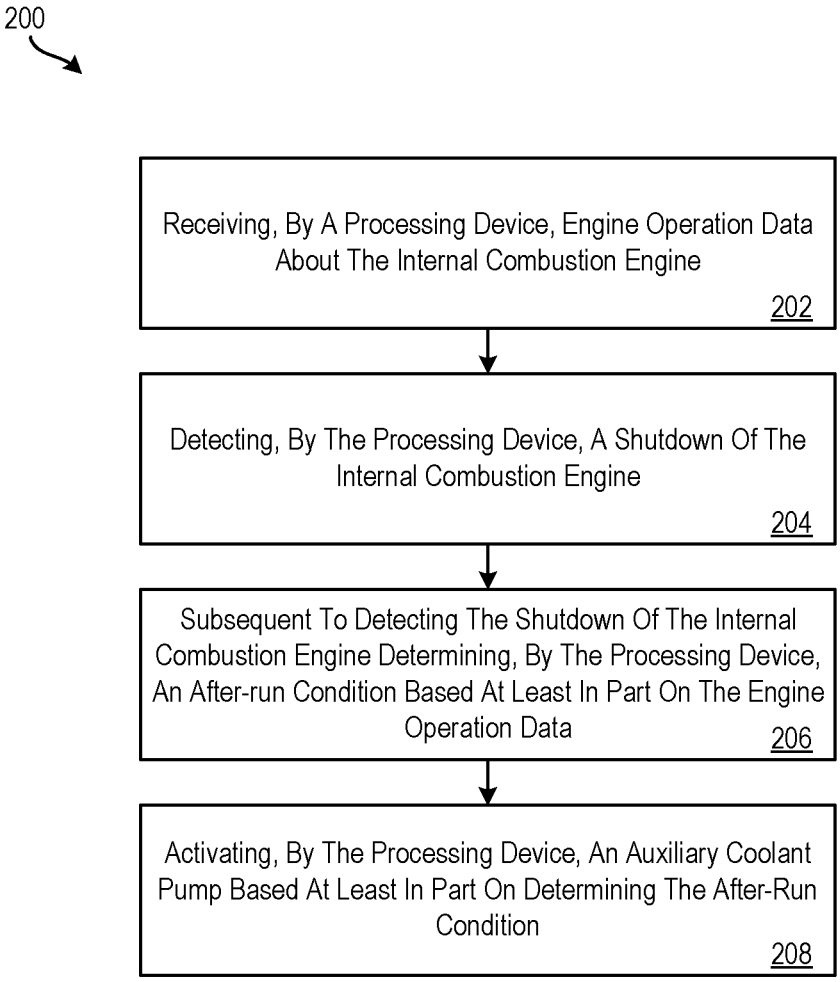
FIG. 2 depicts a flow diagram of a method for controlling coolant fluid in a vehicle cooling system using a secondary coolant pump, according to embodiments of the present disclosure.

FIG. 2 depicts a flow diagram of a method 200 for controlling coolant fluid in a vehicle cooling system using a secondary coolant pump, according to embodiments of the present disclosure. The method 200 may be implemented, for example, by the valve controller 102 of FIG. 1, by the processing system 400 of FIG. 4, or by another suitable processing system or device.

At block 202, the valve controller 102 (i.e., a processing device or system) receives engine operation data about the vehicle engine 100. The engine operation data can include speed data and torque data, among others.

At block 204, the valve controller 102 detects a shutdown of the vehicle engine 100. For example, when the vehicle engine 100 is shut down (e.g., when an operator of the vehicle causes the vehicle engine 100 to be shut down), a command can be sent to the valve controller 102 that indicates that the vehicle engine 100 is shut down.

Subsequent to detecting the shutdown of the vehicle engine 100, the valve controller 102 determines an after-run condition based at least in part on the engine operation data at block 206. The after-run condition can be a high temperature (compared to a temperature threshold), a high average power (compared to a power threshold), and a high average torque (compared to a torque threshold). Thus, if any of the temperature, power, or torque thresholds are exceeded (or met), an after-run condition is determined to exist and a secondary coolant pump 106 is activated at block 208, described in more detail herein. For example, the valve controller 102 calculates an average power based on the speed data and torque data. The valve controller 102 can also calculate an average torque based on the torque data. The calculated average torque and average speed can be compared to torque and speed thresholds respectively. If either (or both) of the thresholds are exceeded (or met), then an after-run condition is determined to exist.

At block 208, the valve controller 102 activates a secondary coolant pump 106 based at least in part on determining the after-run condition. For example, if it is determined that the average torque exceeds the torque threshold, an after-run condition exists, and the secondary coolant pump 106 is activated. By activating the secondary coolant pump 106, the vehicle engine 100 can be protected against overheating (e.g., a boiling condition, hardware damage, etc.) and against overpressure (e.g., coolant leakage from boiling).

Additional processes also may be included, and it should be understood that the processes depicted in FIG. 2 represent illustrations and that other processes may be added or existing processes may be removed, modified, or rearranged without departing from the scope and spirit of the present disclosure.

Figure 3:
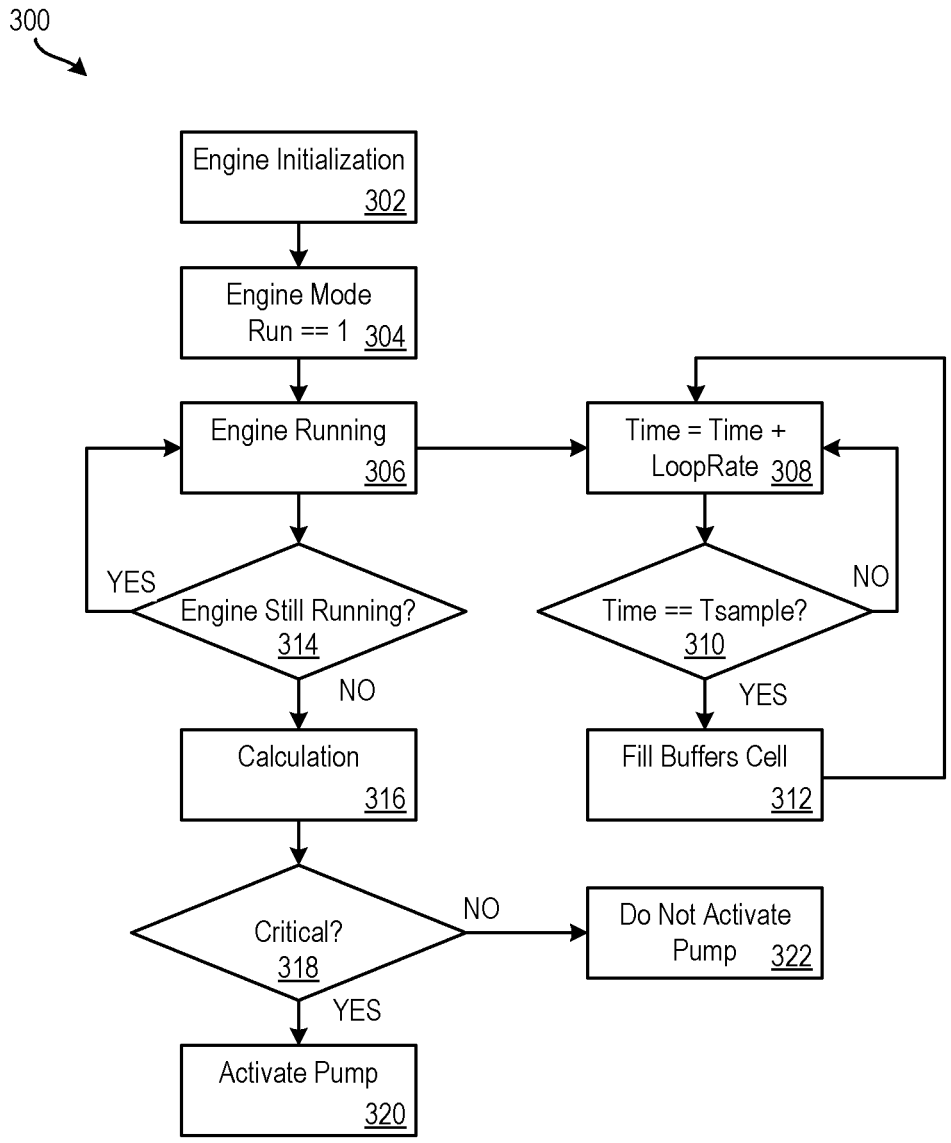
FIG. 3 depicts a flow diagram of a method for controlling coolant fluid in a vehicle cooling system using a secondary coolant pump, according to embodiments of the present disclosure.

FIG. 3 depicts a flow diagram of a method 300 for controlling coolant fluid in a vehicle cooling system using a secondary coolant pump, according to embodiments of the present disclosure. The method 300 may be implemented, for example, by the valve controller 102 of FIG. 1, by the processing system 400 of FIG. 4, or by another suitable processing system or device.

At block 302, the vehicle engine 100 is initialized (i.e., a user turns a key in an ignition, a user presses a button, etc.). At this point, a time variable T is set to 0 and a time sample variable Tsample is set also. The time sample variable Tsample indicates how often a sample is taken. The time sample variable Tsample can be in seconds or hertz. For example, the time sample variable Tsample can be set to 3 seconds, which is approximately 0.33 Hz. At block 304, the engine mode is set to 1, indicating that the vehicle engine 100 is running (block 306).

While the engine is running, two different branches of the method 300 execute concurrently. First, at decision block 314, it is determined whether the vehicle engine 100 is still running. Second, while the engine is running (block 306), the vehicle engine 100 is sampled to acquire engine operation data about the operation of the vehicle engine 100. For example, engine operation data can be acquired about the immediate torque and engine speed during each sample cycle of the vehicle engine 100.

To perform the sampling (collectively blocks 308, 310, 312), the time variable (set at block 302) is updated to add a loop rate, which indicates how long the sampling takes. At decision block 310, it is determined whether the time T is equal to the time sampling variable Tsample. If not, the time T is updated at block 308. If it is determined at decision block 310 that the time T is equal to the time sampling variable Tsample, the engine data is acquired from the vehicle engine 100 and a buffer is filled to include the data acquired. The time sample variable Tsample is updated to be the current Tsample value Tsample plus an old Tsample value Tsample_old.

According to one embodiment, the sampling is performed in a window of 90 seconds using a circular buffer with 30 values sampling at a frequency of 0.33 Hz. If at decision block 314 it is determined that the vehicle engine 100 is not still running, the sampling (collectively blocks 308, 310, 312) ceases, and the method continues to block 316.

At block 316, average power and average torque are calculated for the vehicle engine 100 during the period (e.g., the time sample variable Tsample value) immediately before the engine stop is detected. The average power and average torque are compared. At decision block 318, it is determined whether an after-run condition is met by comparing the average power and average torque to predefined thresholds for power and torque. If one or more of the thresholds are exceeded (or met), an after-run condition is determined to exist at decision block 318, and the secondary pump 106 is activated at block 320. However, if the thresholds are not exceeded (or not met), an after-run condition is determined not to exist at decision block 318, and the secondary pump 106 is not activated at block 322.

At decision block 318, it can also be determined whether a temperature of the vehicle engine 100 is critical (e.g., greater than (or greater than or equal to) a temperature threshold). If the temperature is critical, the secondary pump 106 is activated at block 320. If the temperature is not critical, the secondary pump 106 is not activated at block 322.

According to one or more examples of the present disclosure, the method 300 enables accounting for various vehicle engine 100 operating ranges, including high load, low engine speed (average torque calculation); high load, high engine speed (average power calculation); etc.

Additional processes also may be included, and it should be understood that the processes depicted in FIG. 3 represent illustrations and that other processes may be added or existing processes may be removed, modified, or rearranged without departing from the scope and spirit of the present disclosure.

Figure 4:
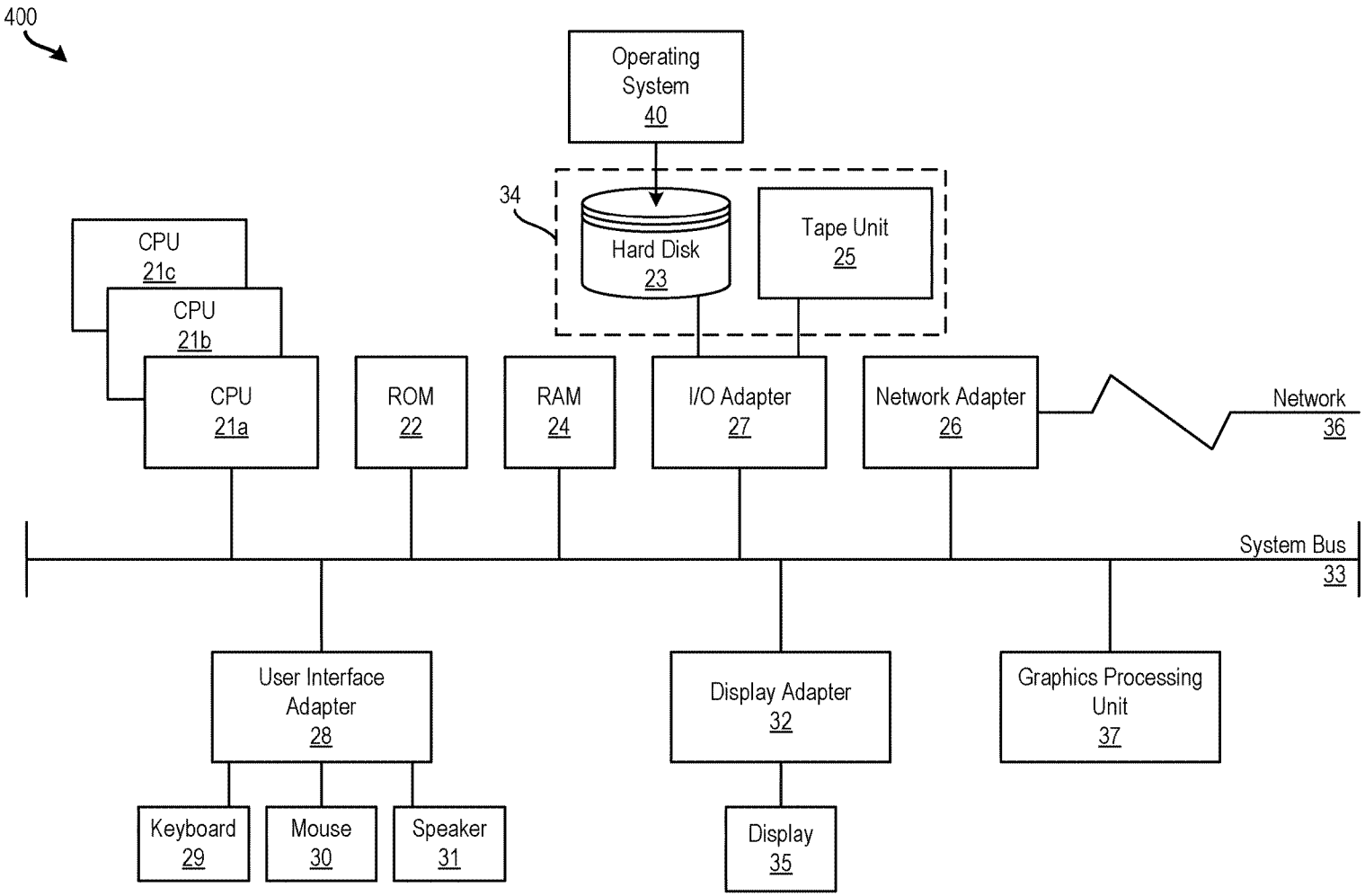
FIG. 4 depicts a block diagram of a processing system for implementing the techniques described herein, according to embodiments of the present disclosure.

It is understood that the present disclosure is capable of being implemented in conjunction with any other type of computing environment now known or later developed. For example, FIG. 4 illustrates a block diagram of a processing system 400 for implementing the techniques described herein. In examples, processing system 400 has one or more central processing units (processors) 21*a*, 21*b*, 21*c*, etc. (collectively or generically referred to as processor(s) 21 and/or as processing device(s)). In aspects of the present disclosure, each processor 21 may include a reduced instruction set computer (RISC) microprocessor. Processors 21 are coupled to system memory (e.g., random access memory (RAM) 24) and various other components via a system bus 33. Read only memory (ROM) 22 is coupled to system bus 33 and may include a basic inlet/outlet system (BIOS), which controls certain basic functions of processing system 400.

Further illustrated are an inlet/outlet (I/O) adapter 27 and a network adapter 26 coupled to system bus 33. I/O adapter 27 may be a small computer system interface (SCSI) adapter that communicates with a hard disk 23 and/or another storage drive 25 or any other similar component. I/O adapter 27, hard disk 23, and storage device 25 are collectively referred to herein as mass storage 34. Operating system 40 for execution on processing system 400 may be stored in mass storage 34. A network adapter 26 interconnects system bus 33 with an outside network 36 enabling processing system 400 to communicate with other such systems.

A display (e.g., a display monitor) 35 is connected to system bus 33 by display adapter 32, which may include a graphics adapter to improve the performance of graphics intensive applications and a video controller. In one aspect of the present disclosure, adapters 26, 27, and/or 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional inlet/outlet devices are shown as connected to system bus 33 via user interface adapter 28 and display adapter 32. A keyboard 29, mouse 30, and speaker 31 may be interconnected to system bus 33 via user interface adapter 28, which may include, for example, a Super I/O chip integrating multiple device adapters into a single integrated circuit.

In some aspects of the present disclosure, processing system 400 includes a graphics processing unit 37. Graphics processing unit 37 is a specialized electronic circuit designed to manipulate and alter memory to accelerate the creation of images in a frame buffer intended for outlet to a display. In general, graphics processing unit 37 is very efficient at manipulating computer graphics and image processing, and has a highly parallel structure that makes it more effective than general-purpose CPUs for algorithms where processing of large blocks of data is done in parallel.

Thus, as configured herein, processing system 400 includes processing capability in the form of processors 21, storage capability including system memory (e.g., RAM 24), and mass storage 34, inlet means such as keyboard 29 and mouse 30, and outlet capability including speaker 31 and display 35. In some aspects of the present disclosure, a portion of system memory (e.g., RAM 24) and mass storage 34 collectively store an operating system to coordinate the functions of the various components shown in processing system 400.

The descriptions of the various examples of the present disclosure have been presented for purposes of illustration, but are not intended to be exhaustive or limited to the embodiments disclosed. Many modifications and variations will be apparent to those of ordinary skill in the art without departing from the scope and spirit of the described techniques. The terminology used herein was chosen to best explain the principles of the present techniques, the practical application or technical improvement over technologies found in the marketplace, or to enable others of ordinary skill in the art to understand the techniques disclosed herein.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present techniques not be limited to the particular embodiments disclosed, but will include all embodiments falling within the scope of the application.

What is claimed is:

1. A computer-implemented method for controlling coolant fluid in cooling system for an internal combustion engine using a secondary coolant pump, the method comprising:

receiving, by a processing device, engine operation data about the internal combustion engine, wherein the engine operation data comprises speed data and torque data;

calculating an average power based at least in part on the speed data and the torque data, and calculating an average torque based at least in part on the torque data;

comparing the average power to a power threshold and comparing the average torque to a torque threshold;

detecting, by the processing device, a shutdown of the internal combustion engine;

subsequent to detecting the shutdown of the internal combustion engine determining, by the processing device, an after-run condition based at least in part on the engine operation data, wherein determining the after-run condition is based at least in part on at least one of the average power exceeding the power threshold or the average torque exceeding the torque threshold; and activating, by the processing device, the secondary coolant pump based at least in part on determining the after-run condition.

2. The computer-implemented method of claim 1, wherein the engine operation data is received periodically and stored in a circular buffer.

3. The computer-implemented method of claim 1, wherein the internal combustion engine comprises a primary coolant pump and the secondary coolant pump.

4. The computer-implemented method of claim 1, wherein the after-run condition is selected from the group consisting of a high temperature, a high average power, and a high average torque.

5. A system for controlling coolant fluid in cooling system for an internal combustion engine using a secondary coolant pump, the system comprising:

a memory comprising computer readable instructions; and a processing device for executing the computer readable instructions, the instructions causing the processing device to:

receive engine operation data about the internal combustion engine;

detect a shutdown of the internal combustion engine;

subsequent to detecting the shutdown of the internal combustion engine, determine an after-run condition based at least in part on the engine operation data, wherein determining the after-run condition is based at least in part on at least one of an average power exceeding a power threshold or an average torque exceeding a torque threshold; and activate the secondary coolant pump based at least in part on determining the after-run condition.

6. The system of claim 5, wherein the engine operation data is received periodically and stored in a circular buffer.

7. The system of claim 5, wherein the engine operation data comprises speed data and torque data.

8. The system of claim 7, the instructions further causing the processing device to:

calculate the average power based at least in part on the speed data and the torque data, and calculate the average torque based at least in part on the torque data; and compare the average power to the power threshold and compare the average torque to the torque threshold.

9. The system of claim 5, wherein the internal combustion engine comprises a primary coolant pump and the secondary coolant pump.

10. The system of claim 5, wherein the after-run condition is selected from the group consisting of a high temperature, a high average power, and a high average torque.

11. A computer program product for controlling coolant fluid in cooling system for an internal combustion engine using a secondary coolant pump, the computer program product comprising:

a non-transitory computer readable storage medium having program instructions embodied therewith, wherein the computer readable storage medium is not a transitory signal per se, the program instructions executable by a processing device to cause the processing device to:

receive engine operation data about the internal combustion engine;

detect a shutdown of the internal combustion engine;

subsequent to detecting the shutdown of the internal combustion engine, determine an after-run condition based at least in part on the engine operation data, wherein determining the after-run condition is based at least in part on at least one of an average power exceeding a power threshold or an average torque exceeding a torque threshold; and activate the secondary coolant pump based at least in part on determining the after-run condition.

12. The computer program product of claim 11, wherein the engine operation data is received periodically and stored in a circular buffer.

13. The computer program product of claim 11, wherein the engine operation data comprises speed data and torque data.

14. The computer program product of claim 11, the instructions further causing the processing device to:

calculate the average power based at least in part on the speed data and the torque data, and calculate the average torque based at least in part on the torque data; and compare the average power to the power threshold and compare the average torque to the torque threshold.

* * * * *